US006586050B1

(12) United States Patent
Fort

(10) Patent No.: US 6,586,050 B1
(45) Date of Patent: Jul. 1, 2003

(54) METHOD OF APPLYING SIFTPROOF ADHESIVE PATTERN

(75) Inventor: Wesley C. Fort, Norcross, GA (US)

(73) Assignee: Nordson Corporation, Westlake, OH (US)

( * ) Notice: Subject to any disclaimer, the term of this patent is extended or adjusted under 35 U.S.C. 154(b) by 367 days.

(21) Appl. No.: 09/702,430

(22) Filed: Oct. 31, 2000

(51) Int. Cl.[7] ..... B05D 5/10
(52) U.S. Cl. ..... 427/286; 427/288; 427/208.6
(58) Field of Search ..... 427/207.1, 208.2–208.6, 427/256, 284–5, 286, 288; 118/313–315, 323, 324

(56) References Cited

U.S. PATENT DOCUMENTS

| | | | | |
|---|---|---|---|---|
| 3,194,474 A | | 7/1965 | Rumberger | 129/37 |
| 3,348,519 A | | 10/1967 | Dyess, Jr. et al. | 118/2 |
| 3,831,342 A | * | 8/1974 | Rejsa | |
| 3,934,791 A | | 1/1976 | Dick et al. | 229/37 |
| 4,009,498 A | | 3/1977 | Staats et al. | 11/1 |
| 4,010,203 A | | 3/1977 | Aylon | 156/578 |
| 4,256,526 A | * | 3/1981 | McDaniel | |
| 4,484,850 A | | 11/1984 | Shimizu | 412/11 |
| 4,498,619 A | | 2/1985 | Roccaforte | 229/52 |
| 4,836,440 A | * | 6/1989 | French | |
| 5,401,791 A | | 3/1995 | Milks | 524/270 |
| 5,426,920 A | | 6/1995 | Quadalti | 53/564 |
| 5,472,137 A | | 12/1995 | Jenkins | 229/134 |
| 5,540,774 A | | 7/1996 | Smitherman | 118/315 |
| 5,688,218 A | | 11/1997 | Jenkins | 493/151 |
| 5,711,477 A | | 1/1998 | Jenkins | 229/136 |
| 5,773,095 A | | 6/1998 | Coker | 427/424 |
| 5,806,756 A | | 9/1998 | Jenkins | 229/136 |

OTHER PUBLICATIONS

Nordson Corporation, engineering drawings of prior adhesive patterns on adhesive flaps, No. 1–117, undated.

Industrial Devices Corporation, *Linear & Rotary Positioning Systems & Controls,* Catalog, 1998.

* cited by examiner

*Primary Examiner*—Fred J. Parker
(74) *Attorney, Agent, or Firm*—Wood, Herron & Evans, LLP

(57) ABSTRACT

A method of applying adhesive to major and minor flaps of a container in a siftproof adhesive pattern. A pair of adhesive dispensing guns are independently moved with respect to the flaps of the container as the container is conveyed past the guns. Electric actuators, such as linear modules or rotatable servo modules, are used to rapidly accelerate the guns in a direction perpendicular to the path of the container along a conveyor. In this manner, rapid packaging takes place and reliable siftproof patterns are achieved using minimal adhesive.

11 Claims, 3 Drawing Sheets

METHOD OF APPLYING SIFTPROOF ADHESIVE PATTERN

FIELD OF THE INVENTION

The present invention generally relates to methods for sealing containers and, more specifically, to methods of sealing containers in a siftproof manner designed to prevent leakage of particulate contents or infestation by insects.

BACKGROUND OF THE INVENTION

Many containers, such as cartons, boxes or other less rigid containers, are constructed from paper-based materials and include open ends each having a plurality of flaps. Typically, the flaps at each end include a pair of opposed major flaps and a pair of opposed minor flaps. The containers are usually folded from a flat condition into an erected condition, after which a desired product may be introduced into the container. The flaps are then folded and connected together, typically using an adhesive, to close the opposite ends of the container. The minor flaps are folded down first and the major flaps are folded down next and sealed to upper surfaces of the minor flaps using adhesive.

Particulate products, such as granulated or powdered products, require packaging that prevents leakage of the product during shipment and storage. Plastic liners may be used inside the container for this purpose, however, such liners increase packaging costs. To reduce costs, linerless siftproof containers and sealing methods have been developed for storing and shipping particulate products. The end flaps of these siftproof containers must be tightly sealed in a manner that prevents the contents from sifting out between the flaps and which likewise prevents infestation by insects through gaps between the flaps. In the past, all of the flaps have received adhesive deposits in the form of intermittent or continuous adhesive beads to ensure that the seams between the various flaps are sealed in a siftproof manner.

As the development of siftproof containers has progressed, certain problems have been addressed relative to siftproof seal integrity and costs associated with the adhesive and the paper construction products. For example, embossments have been used on the various flaps to provide opposed surfaces lying in close relation such that the gap between the flaps does not need to be filled with as much adhesive. Other siftproof containers have been configured to include a modified first major flap that enables direct contact between embossed portions of the minor flaps and a corresponding embossed portion of the second major flap. While these improvements have helped in some regards, modifying containers in these manners can also add expense and some containers cannot have embossed or otherwise modified flaps.

Other problems in this art relate to the need for a large of number of adhesive dispensers, or adhesive dispensing nozzles, necessary to place the corresponding number of beads on the container flaps extending in the conveying path of the containers. The increased complexity of the dispensing system increases costs and complicates changeover procedures. In this latter regard, for containers of different configurations and/or sizes, dispensing guns must be removed or added, or nozzles must be removed and plugged or added to accommodate the new configuration or container size.

Despite the various developments in the area of siftproof containers, improvements are still needed to maintain siftproof seal integrity while reducing adhesive requirements and general manufacturing costs. In this regard, the use of continuous adhesive sealing beads as opposed to a number of intermittent short and long beads only extending parallel to the conveying path requires much less adhesive and lower manufacturing equipment and changeover costs due to the lower number of necessary adhesive guns. However, applying a continuous adhesive bead in a direction generally perpendicular to the conveying path during high speed packaging operations has been a troublesome problem. Many packaging lines are designed to move at a rate of approximately 400–500 ft./min. or above and, at these high speeds, applying accurate beads of adhesive perpendicular to the direction of the conveying path has been a problem inadequately addressed by prior siftproof packaging systems. With the prior art high speed siftproof packaging methods, beads of adhesive have been applied only in the direction of the conveying path in order to deal with this problem. This results in the use of much more adhesive than necessary to create a siftproof pattern and necessitates the use of multiple side-by-side adhesive dispensing guns and/or nozzles mounted adjacent the conveying path.

To solve these and other problems in the art, it would be desirable to provide a method of applying a siftproof pattern of adhesive to the major and minor flaps of a container while using less adhesive and a lower number of adhesive dispensing components while still maintaining a high production rate in a high speed packaging operation.

SUMMARY OF THE INVENTION

The present invention provides a method of applying adhesive to respective first and second major flaps and first and second minor flaps of a container in a siftproof pattern. The container is moved along a conveying path with the major flaps being folded in an outwardly extending position and the minor flaps being folded in an inwardly extending position. With the container moving along the conveying path, a first gun is moved relative to the container while dispensing a first bead of adhesive therefrom along respective first edges of the first major flap and the first minor flap while moving the first dispensing gun in a direction generally perpendicular to the conveying path. The first bead may be applied starting on the first minor flap and moving onto the first major flap or vice versa. A second gun is moved relative to the container while dispensing a second bead of adhesive therefrom starting along the first edge of the first minor flap and continuing along a first edge of the second major flap in a direction generally perpendicular to the conveying path. With the first bead of adhesive completed and the first gun shut off, the second bead of adhesive is continued with the second gun held stationary. During this time, the container continues to move along the conveying path. The second bead of adhesive is continued along a second edge of second major flap in a direction generally parallel to the conveying path. The second bead of adhesive is then continued along a third edge of the second major flap and extending onto the second minor flap while moving the second dispensing gun again in a direction generally perpendicular to the conveying path. Preferably simultaneously with the dispensing of the second bead of adhesive along the third edge of the second major flap, a third bead of adhesive is dispensed from the first dispensing gun and extends along an edge of the first major flap and onto the second minor flap in a direction generally perpendicular to the conveying path and generally parallel to the first bead of adhesive. Like the first bead of adhesive, this third bead of adhesive may be started on the first major flap and extend onto the second minor flap or vice versa. The major flaps are then folded and sealed to the minor flaps by folding the first major flap onto the minor flaps and then folding the second major flap onto the first major flap.

In the preferred embodiment of the invention, only first and second adhesive dispensing guns are necessary in a high speed packaging operation to apply beads of adhesive in a siftproof pattern using minimal adhesive. Quick movements perpendicular to the direction of the conveying path will result in the necessary generally perpendicular beads of adhesive at opposite ends of the major and minor flaps. In the preferred embodiment, electric gun movers, such as linear actuators or servomotors with rotatable outputs, are used to facilitate this quick perpendicular movement. Even with the speed of the container along the conveying path reaching 400–500 ft./min. or above, the adhesive beads necessary in the direction generally perpendicular to the conveying path may be made, while the longer sealing bead extending in the direction of the conveying path is easily placed with the corresponding gun held in a stationary position.

In the preferred embodiment, the first and second guns are mounted along a linear guide rod and are initially moved in opposite directions perpendicular to the conveying path to apply respective beads of adhesive extending from the first minor flap onto the respective first and second major flaps. The first gun is then shut off or closed and the second gun is maintained on or opened to dispense a portion of the second bead along an edge which extends parallel to the conveying path. When the end of this portion of the bead is reached, the first dispensing gun is actuated to again dispense a bead of adhesive and each of the dispensing guns is moved toward the other in a direction generally perpendicular to the conveying path to again dispense beads of adhesive that extend from the first and second major flaps onto the second minor flap. This completes the siftproof pattern for the container and this method is repeated for each container continuously moving along the conveying path.

In an alternative embodiment, electrically-actuated servomotors with rotatable outputs are used to move the first and second guns in a generally perpendicular direction to the conveying path for the purposes discussed above. The manner of placing the adhesive beads is otherwise the same as discussed above with respect to the preferred embodiment. This alternative embodiment may also have manual adjustment mechanisms for accommodating containers and/or container flaps of different configurations and sizes. In each embodiment, the accommodation of containers and/or flaps of different sizes and configurations also may be made by suitable adjustment in an electrical control controlling the extent of movement for one or both dispensing guns.

These and other objects, advantages, and features of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
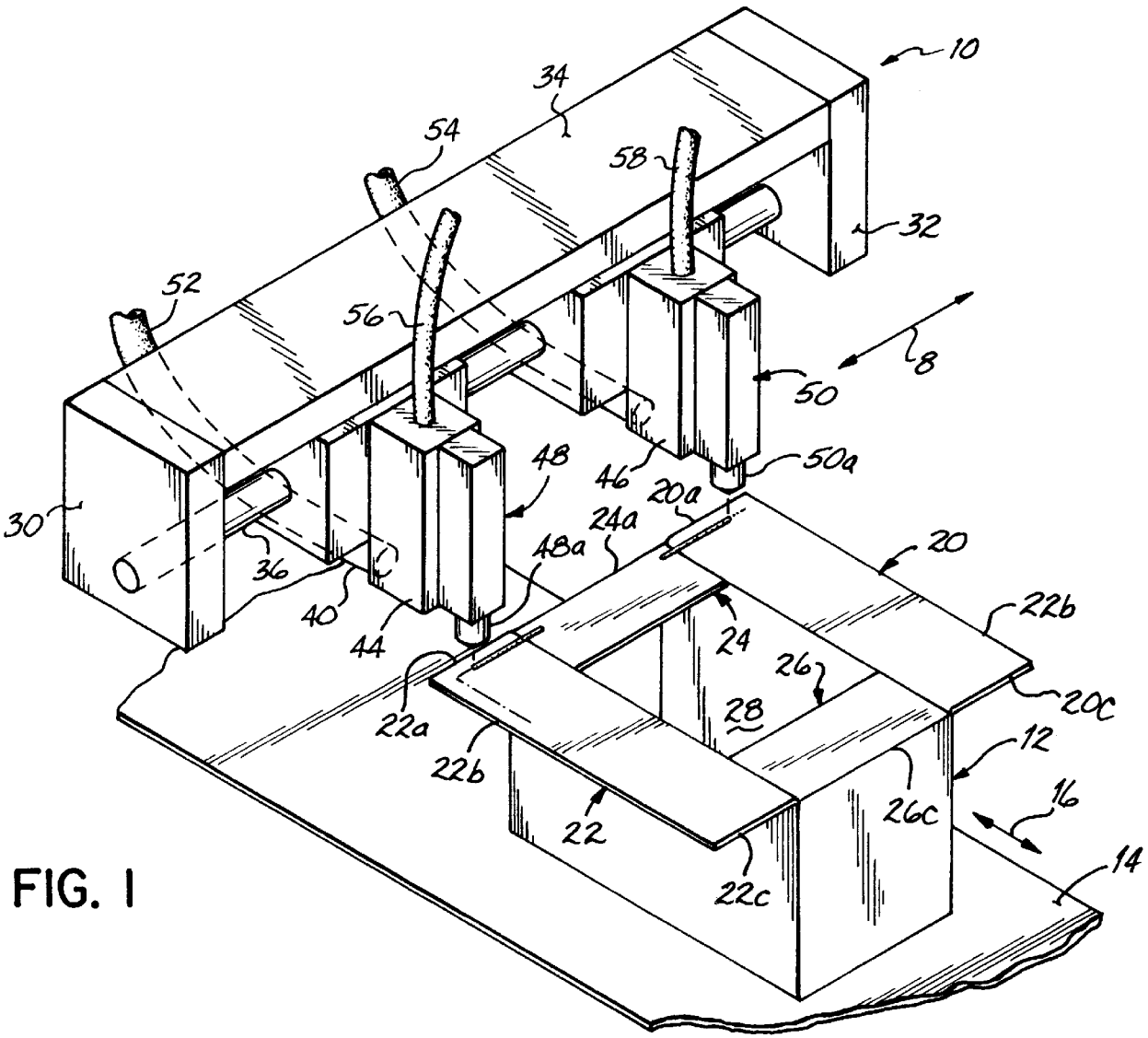
FIG. 1 is a fragmented perspective view schematically illustrating an adhesive dispensing system and gun mover for applying a siftproof adhesive pattern to the flaps of a container.
Figure 2:
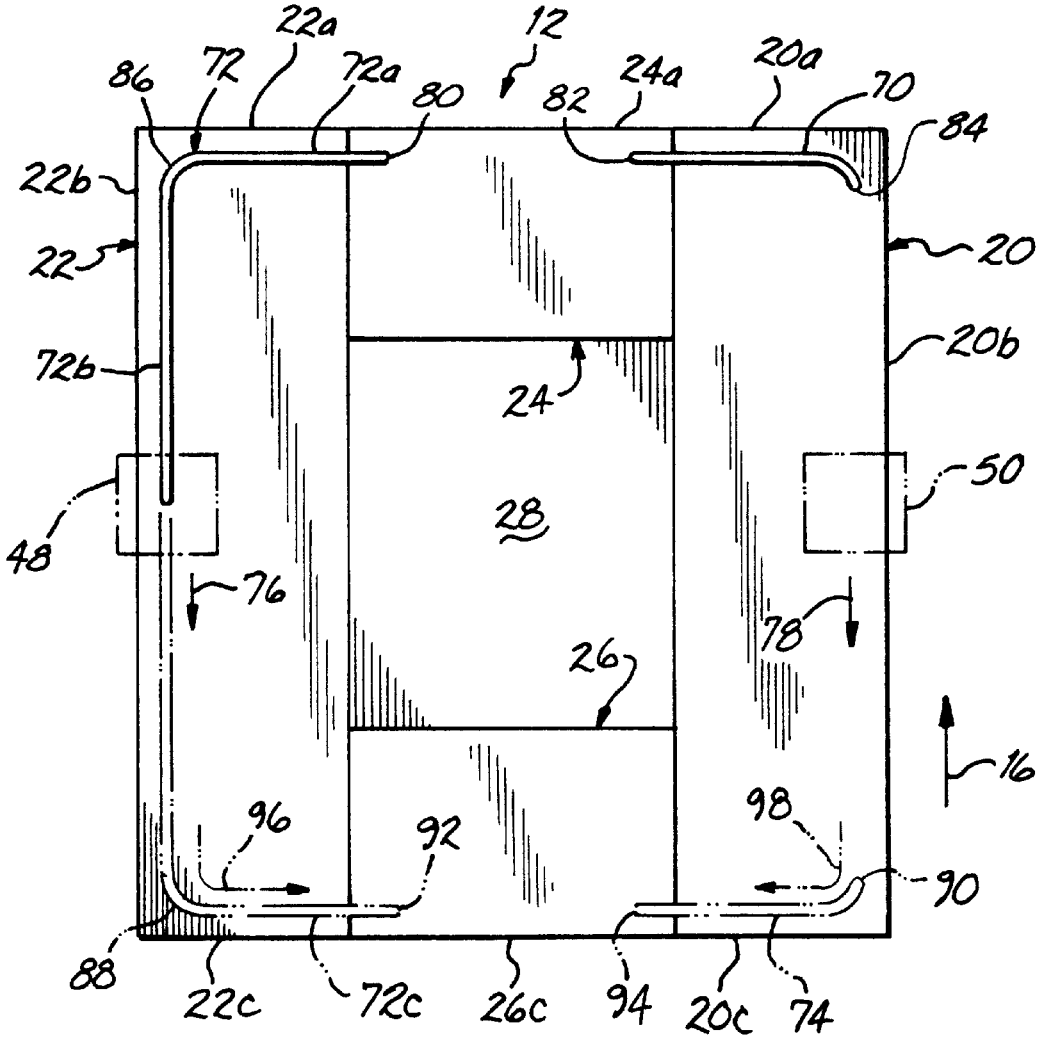
FIG. 2 is a top plan view of the container shown in FIG. 1, but schematically illustrating application of the preferred siftproof pattern.

Referring to FIGS. 1 and 2, an adhesive dispensing apparatus 10 is illustrated for applying adhesive beads to a container 12. Container 12 travels along a conveyor 14 along a path indicated by directional arrows 16. Conveyor 14 is schematically illustrated as a belt, however, in practice, such conveyors take many different forms depending on the packaging operation and container requirements. Container 12 includes a first major flap 20, a second major flap 22, a first minor flap 24 and a second minor flap 26. Minor flaps 24, 26 are folded inwardly toward an interior 28 of container 12, while major flaps 20, 22 are folded outwardly with respect to container interior 28. This configures container 12 for receipt of the siftproof adhesive bead pattern to be discussed below.

Apparatus 10 more specifically includes a pair of vertical support members 30, 32 coupled to a horizontal support member 34 and carrying a horizontal guide element 36 in the form of a cylindrical rod. A pair of linear electric motors 40, 42 are received on guide element 36 for providing positioning and linear movement of manifolds 44, 46 and dispensing guns 48,50 in a direction 8 generally perpendicular to conveying path 16. Electrically actuated and controlled linear motion devices of this type are available as LM Series Linear Modules from Industrial Devices Corporation in Petaluma, Calif. Respective manifolds 44, 46 are affixed to linear motors 40, 42. Manifolds 44, 46 further carry respective adhesive dispensing guns 48, 50 configured to dispense adhesive from nozzles 48*a*, 50*a* in an on/off fashion. Adhesive dispensing guns 48, 50 can be pneumatic such as the H200 or H400 Series dispensing guns from Nordson Corporation of Westlake, Ohio, or an electric gun, such as the NORDSON® E350 Series. However, other types of pneumatically or electrically-actuated on/off type guns may be used as well. Adhesive is carried to guns 48, 50 through their respective manifolds 44, 46 which are in fluid communication with adhesive supply hoses 52, 54. A pair of pressurized air hoses 56, 58 feed air to manifolds 44, 46. This air is supplied through manifolds 44, 46 to guns 48, 50 in order to actuate guns 48, 50 between on and off conditions.

When guns 48, 50 are on or in open positions, pressurized adhesive will flow through hoses 52, 54, manifolds 44, 46 and nozzles 48*a*, 50*a* and discharge as respective beads 70, 72, 74 in accordance with the method of this invention. Bead 70 extends along respective edges 20*a*, 24*a* of first major flap 20 and first minor flap 24. Bead 74 extends along respective edges 20*c*, 26*c* of first major flap 20 and second minor flap 26. Bead 72 is comprised of connected portions 72*a*, 72*b*, 72*c*. Bead portions 72*a*, 72*b*, 72*c* respectively extend along a first edge 22*a*, a second edge 22*b*, and a third edge 22*c* of second major flap 22. Bead portions 72*a*, 72*c* further extend onto respective edges 24*a*, 26*c* of first and second minor flaps 24, 26.

Container 12 is shown moving in the direction of arrow 16 along a conveyor 14. FIG. 2 more specifically illustrates the adhesive application in progress with bead 70, bead portion 72*a* and part of bead portion 72*b* having been already applied. With container 12 moving in the direction of arrow 16 at a high rate of speed, such as approximately 500 ft./min., and with guns 48, 50 respectively turned on directly above starting points 80, 82, linear motors 40, 42 rapidly move guns 48, 50 in an outward direction away from each other to locations 84, 86. At location 84, gun 50 is turned off or closed to stop dispensing adhesive and its motion perpendicular to conveying path 16 is also stopped by deactivating motor 42. At location 86, the motion of gun 48 perpendicular to conveying path 16 is stopped by deactivating motor 40, however, gun 48 is maintained on or in an opened condition to continue dispensing adhesive bead portion 72*b* in a substantially parallel direction relative to conveying path 16. Although guns 48, 50 are physically stationary during this part of the process, they move relative to container 12 in the directions of arrows 76, 78 due to the physical movement of container 12 in the opposite direction 16.

At locations 88, 90, guns 48, 50 are simultaneously moved toward each other via motors 40, 42 to points 92, 94 in a direction perpendicular to conveying path 16 as indicated by arrows 96, 98. At location 88, gun 48 is maintained on to apply bead portion 72*c*, while gun 50 is turned on at location 90 to apply bead 74. When locations 92, 94 are respectively reached, guns 48, 50 are turned off or closed to stop the discharge of adhesive and motors 40, 42 are deactivated to stop the perpendicular travel of guns 48, 50. At locations 92, 94, guns 48, 50 are located at their respective starting positions ready for the next container and a repeat of the same siftproof adhesive bead application.

Preferably, to apply accurate beads of adhesive perpendicular to conveying path 16, specifically in the form of beads 70 and 74 and bead portions 72*a*, 72*c*, the speed of guns 48, 50 moving in the perpendicular direction must be sufficient relative to the speed of conveyor 14 to ensure that beads 70, 74 and bead portions 72*a*, 72*c* do not curve substantially or become substantially angled away from perpendicular. In the present embodiment, with a conveyor speed in the range of 400–500 ft./min. the speed of guns 48, 50 in a direction perpendicular to conveyor 14 should be in the range of 1500–2000 ft./min. In the above-mentioned linear servo module, conventional controls may be used to program the extent that guns 48, 50 are moved in the perpendicular direction and also to control the speed of movement. It will be appreciated that these control features may be utilized to accommodate containers of various configurations and sizes, and packaging operations of various speeds.

Figure 3:
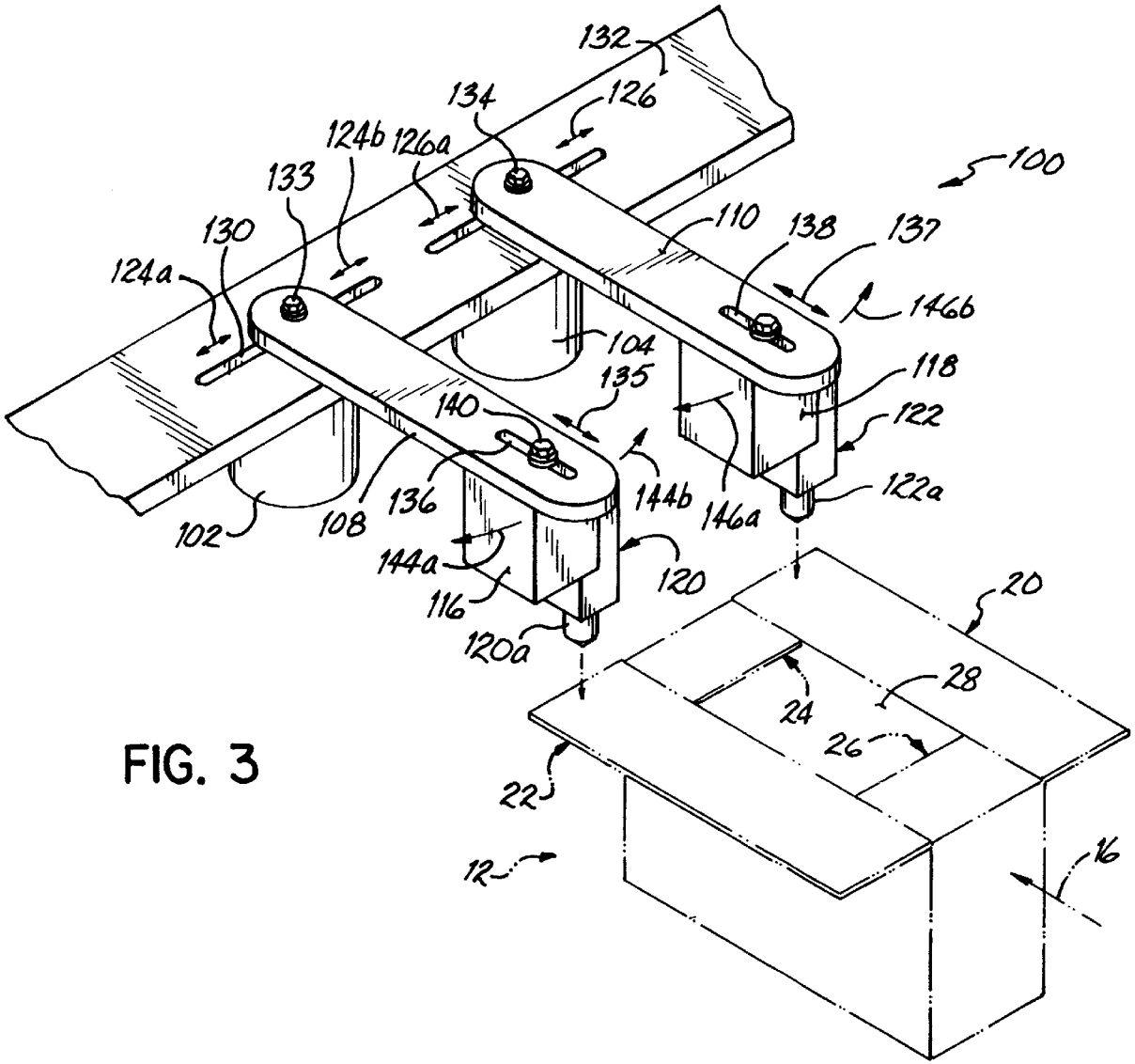
FIG. 3 is a fragmented perspective view showing an alternative apparatus for applying a siftproof pattern in accordance with the inventive concepts.

FIG. 3 illustrates an alternative embodiment comprising an apparatus 100 configured to apply the same adhesive bead pattern to a container 12 as discussed above with respect to FIGS. 1 and 2. In FIG. 3, like reference numerals refer to like elements in each embodiment. Apparatus 100 includes respective first and second servomotors 102, 104 coupled to support members 108, 110. Support members 108, 110 carry first and second manifolds 116, 118 and first and second adhesive guns 120, 122 with nozzles 120*a*, 122*a* similar to the first embodiment. The adhesive and air hoses have been deleted for clarity. As indicated by arrows 124*a*, 124*b* and 126*a*, 126*b* the physical spacing between guns 120, 122 may be changed through the use of a slot 130 in a horizontal support 132. After the adjustment is made, servomotors 102, 104 and support members 108, 110 are fixed by suitable fasteners 133, 134 to prevent longitudinal movement along slot 130. However, the connections formed with fasteners 133, 134 allow support members 108, 110 to rotate about their connection points. For example, suitable bearings may be provided for this purpose. The position of guns 120, 122 may be changed in the direction of the conveying path 16, as indicated by arrows 135, 137, through the use of a second pair of slotted connections between support members 108, 110 and manifolds 116, 118. These connections similarly comprise slots 136, 138 and fasteners 140, 142. A certain amount of adjustment may also be obtained by electrically controlling the extent of rotation by servomotors 102, 104.

Servomotors 102, 104 rotate support members 108, 110 to move the respective guns 120, 122 back-and-forth along an arcuate path, indicated by arrows 144*a*, 144*b* and 146*a*, 146*b* to apply the necessary generally perpendicular beads, illustrated as beads 70, 74 and bead portions 72*a*, 72*c* in FIG. 2. The sequence of bead application is preferably the same as discussed in connection with FIG. 2. While the motion of guns 48, 50 in the first embodiment is in a purely linear direction perpendicular to conveying path 16, the rotational movement of guns 120, 122 in this second embodiment will not adversely affect the integrity of the siftproof seal. That is, the rotation of guns 120, 122 occurs through such a short and slight arcuate path that the application of adhesive beads 70, 74 and bead portions 72*a*, 72*c* will result in substantially perpendicular beads similar to those shown in FIG. 2.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein I claim:

What is claimed is:

1. A method of applying adhesive to respective first and second major flaps and first and second minor flaps of a container in a siftproof pattern, the method comprising:

a) moving the container along a conveying path, said major flaps being folded in an outwardly extending position and said minor flaps being folded in an inwardly extending position;

b) moving a first gun relative to the container while dispensing a first bead of adhesive therefrom along respective aligned first edges of the first major flap and the first minor flap in a direction generally perpendicular to the conveying path;

c) independently moving a second gun relative to the container while dispensing a second bead of adhesive beginning along the first edge of the first minor flap and extending along a first edge of the second major flap in a direction generally perpendicular to the conveying path;

d) stopping the dispensing of the first bead of adhesive;

e) holding the second gun stationary while continuing to dispense the second bead of adhesive along a second edge of the second major flap in a direction generally parallel to the conveying path;

f) continuing the dispensing of the second bead of adhesive along a third edge of the second major flap and extending onto the second minor flap while moving the second dispensing gun in a direction generally perpendicular to the conveying path; and g) dispensing a third bead of adhesive while moving the first dispensing gun in a direction generally perpendicular to the conveying path, the third bead of adhesive extending along aligned edges of the first major flap and the second minor flap in a generally parallel orientation relative to the first bead of adhesive.

2. The method of claim 1, wherein moving the first and second guns further comprises moving the guns with respective electric actuators along a linear guide element disposed substantially perpendicularly to the conveying path.

3. The method of claim 1, wherein moving the first and second guns further comprises moving the guns through an arcuate path extending generally perpendicular to the conveying path with respective electric actuators.

4. The method of claim 1, wherein steps b) and c) are carried out in a simultaneous manner.

5. The method of claim 1, wherein steps f) and g) are carried out in a simultaneous manner.

6. The method of claim 1, wherein steps b), c), f) and g) are carried out in a simultaneous manner.

7. The method of claim 1, wherein the first and second guns are positioned at respective starting positions prior to step b) and respectively return to their starting positions at the completion of steps f) and g).

8. A method of applying adhesive to form a siftproof seal to a container having respective first and second major flaps and first and second minor flaps, the method comprising the steps of:

a) moving the container along a conveying path, said major flaps being folded in an outwardly extending position and said minor flaps being folded in an inwardly extending position;

b) moving a first gun while dispensing a first bead of adhesive in a general "C" shaped pattern, the first bead extending along first, second, and third edges of the second major flap, and extending onto the first and second minor flaps;

c) independently moving a second gun while dispensing a second bead of adhesive therefrom along respective aligned edges of the first major flap and the first minor flap;

d) moving the second gun to dispense a third bead of adhesive extending along respective aligned edges of the first major flap and the second minor flap in a generally parallel orientation relative to the second bead of adhesive.

9. The method of claim 8, wherein moving the first and second guns further comprises moving the guns with respective electric actuators along a linear guide element disposed substantially perpendicularly to the conveying path.

10. The method of claim 8, wherein moving the first and second guns further comprises moving the guns through an arcuate path extending generally perpendicular to the conveying path with respective electric actuators.

11. The method of claim 8, wherein portions of the first bead which extend along the first and third edges of the second major flap are respectively aligned with the second and third beads.

* * * * *